US010158961B1

(12) United States Patent
Ayotte

(10) Patent No.: US 10,158,961 B1
(45) Date of Patent: Dec. 18, 2018

(54) METHOD AND SYSTEM FOR CALIBRATING A SOUND SIGNAL IN A PLAYBACK AUDIO SYSTEM

(71) Applicant: CAE INC., Saint-Laurent (CA)

(72) Inventor: Maxime Ayotte, Saint-Laurent (CA)

(73) Assignee: CAE INC., Montreal, QC (CA)

( * ) Notice: Subject to any disclaimer, the term of this patent is extended or adjusted under 35 U.S.C. 154(b) by 0 days.

(21) Appl. No.: 15/939,464

(22) Filed: Mar. 29, 2018

(51) Int. Cl.
*H04S 7/00* (2006.01)
*G10K 11/178* (2006.01)

(52) U.S. Cl.
CPC ..... *H04S 7/301* (2013.01); *G10K 11/17815* (2018.01); *H04S 2400/15* (2013.01)

(58) Field of Classification Search
CPC ..... H04S 7/301; H04S 2400/15; G10K 11/17815
See application file for complete search history.

(56) References Cited

U.S. PATENT DOCUMENTS

| | | | | |
|---|---|---|---|---|
| 6,212,499 | B1 * | 4/2001 | Shigeeda | G10L 15/285 704/231 |
| 9,351,060 | B2 | 5/2016 | Wilker et al. | |
| 9,495,975 | B2 | 11/2016 | Short et al. | |
| 9,666,181 | B2 | 5/2017 | Krause et al. | |
| 9,679,563 | B2 | 6/2017 | Lee et al. | |
| 2015/0088500 | A1 | 3/2015 | Conliffe | |
| 2017/0242651 | A1 | 8/2017 | Lang et al. | |
| 2017/0243576 | A1 | 8/2017 | Millington et al. | |
| 2017/0243577 | A1 | 8/2017 | Wingate | |

* cited by examiner

*Primary Examiner* — Mark Fischer
(74) *Attorney, Agent, or Firm* — Fasken Martineau Dumoulin LLP

(57) ABSTRACT

There is described a computer-implemented method for calibrating a sound signal, comprising: receiving an initial sound signal, a recorded background sound signal, a recorded initial sound signal and a target sound signal; subtracting the recorded background sound signal from the recorded initial sound signal, thereby obtaining a denoised sound signal; dividing the target sound signal by the denoised sound signal, thereby obtaining a compensation factor; dividing the initial sound signal by the compensation factor, thereby obtaining a calibrated sound signal; and outputting the calibrated sound signal.

19 Claims, 4 Drawing Sheets

METHOD AND SYSTEM FOR CALIBRATING A SOUND SIGNAL IN A PLAYBACK AUDIO SYSTEM

TECHNICAL FIELD

The present invention relates to the field of methods and system for calibrating sound level in a playback audio system, and more particularly for calibrating coherent sound pressure level.

BACKGROUND

In order to calibrate sound signal, some sound systems apply equalization filter on the channels of the signal while discarding the inter-channel wave cancellation that might occur. This results in an expected frequency response when played through only one channel but in an unexpected frequency response when played through multiple-channels due to interferences.

Some sound systems have been developed to account for these interferences experimentally and very quickly. However, such sound systems must be recalibrated every time the frequency distribution changes and are subject to inter-model interferences when multiple models play the same signals.

Therefore, there is a need for an improved method and system for calibrating a sound signal.

SUMMARY

According to a first broad aspect, there is provided a computer-implemented method for calibrating a sound signal, comprising: receiving an initial sound signal, a recorded background sound signal, a recorded initial sound signal and a target sound signal; subtracting the recorded background sound signal from the recorded initial sound signal, thereby obtaining a denoised sound signal; dividing the target sound signal by the denoised sound signal, thereby obtaining a compensation factor; dividing the initial sound signal by the compensation factor, thereby obtaining a calibrated sound signal; and outputting the calibrated sound signal.

In one embodiment, the initial sound signal, the recorded background sound signal, the recorded initial sound signal and the target sound signal are expressed in a logarithmic scale, the method further comprising converting the initial sound signal and the recorded background sound signal from the logarithmic scale into linear Pascal (Pa) scale before said subtracting the recorded background sound signal from the recorded initial sound signal and converting the denoised sound signal from Pa into the logarithmic scale, said dividing the target sound signal by the denoised sound signal comprises subtracting the denoised sound signal from the target sound signal and said dividing the initial sound signal by the compensation factor comprises subtracting the compensation factor from the initial sound signal.

In one embodiment, the method further comprises recording background noise, thereby obtaining the recorded background sound signal.

In one embodiment, the method further comprises playing back the initial sound signal.

In one embodiment, the method further comprises recording the played back initial sound signal, thereby obtaining the recorded initial sound signal.

In one embodiment, the initial sound signal comprises a white noise signal.

In one embodiment, the noise signal comprises a random noise signal.

In another embodiment, the noise signal comprises a predetermined noise signal.

In one embodiment, the method further comprises: receiving an identification; and retrieving said initial sound signal from a database based on said identification.

In one embodiment, the identification comprises a given flight phase.

In one embodiment, the method further comprises: receiving an identification; and retrieving said target sound signal from a database based on said identification.

In one embodiment, the identification comprises a given flight phase.

In one embodiment, said outputting the calibrated sound signal comprises at least one of storing the calibrated sound signal and playing back the calibrated signal In one embodiment, the method further comprises playing back and muting the predefined audio signal while said recording the background sound signal.

According to another broad aspect, there is provided a computer program product for calibrating a predefined sound signal, the computer program product comprising a computer readable memory storing computer executable instructions thereon that when executed by a computer perform the steps of the above-described method.

According to another broad aspect, there is provided a system for calibrating a predefined sound signal, the system comprising a communication unit for at least one of receiving and transmitting data, a memory and processing unit configured for executing the steps of the above-described method.

According to still another broad aspect, there is provided a system for calibrating a predefined sound signal, the system comprising: a playback module for playing back an initial sound signal, the playback module comprising at least one loudspeaker; a recording module for recording background noise to obtain a background sound signal and recording the played back initial sound signal to obtain a recorded initial signal, the recording module comprising a microphone; a denoising module for subtracting the recorded background sound signal from the recorded initial sound signal to obtain a denoised sound signal; a compensation module for receiving a target sound signal and dividing the target sound signal by the denoised sound signal to obtain a compensation factor; and a calibration module for: dividing the initial sound signal by the compensation factor to obtain a calibrated sound signal; and outputting the calibrated sound signal In one embodiment, the initial sound signal, the recorded background sound signal, the recorded initial sound signal and the target sound signal are expressed in a logarithmic scale, the denoising module is further configured for converting the initial sound signal and the recorded background sound signal from the logarithmic scale into Pascal (Pa) before subtracting the recorded background sound signal from the recorded initial sound signal and converting the denoised sound signal from Pa into the logarithmic scale, the compensation module is configured for subtracting the denoised sound signal from the target sound signal and the calibration module is configured for subtracting the compensation factor from the initial sound signal.

In one embodiment, the initial sound signal comprises a white noise signal.

In one embodiment, the noise signal comprises a random noise signal.

In one embodiment, the noise signal comprises a predetermined noise signal.

In one embodiment, the playback module is further configured for: receiving an identification; and retrieving said initial sound signal from a database based on said identification.

In one embodiment, the identification comprises a given flight phase.

In one embodiment, the compensation module is further configured for: receiving an identification; and retrieving said target sound signal from a database based on said identification.

In one embodiment, the identification comprises a given flight phase.

For the purpose of the present disclosure, a sound signal should be understood as the amplitude of a sound for a given frequency range. Therefore, a sound signal comprises no phase component.

In one embodiment, the recorded initial signal and background signal are converted from time domain to frequency domain by the recording module.

In one embodiment, the calibrated sound signal is converted from frequency domain to time by the calibration module.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION

Figure 1:
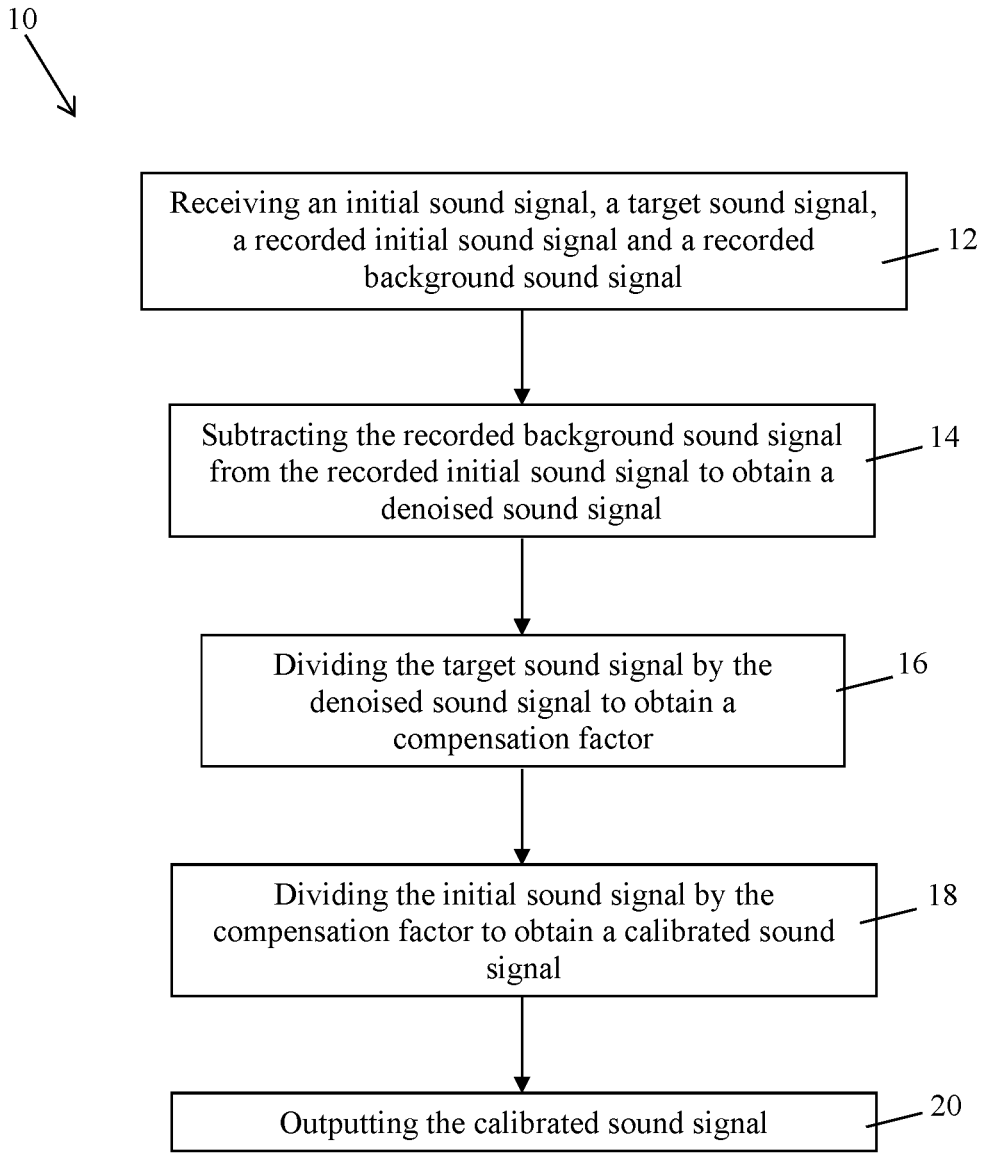
FIG. 1 is a flow chart illustrating a method for calibrating a predefined sound signal, in accordance with an embodiment.

In the following there is described a method and system for calibrating the sound level of a sound system used for playing back sound signals. The sound signals to be played back by the sound system may be sound signals generated by a computer or sound signals that have been previously recorded.

In order to calibrate the sound level for the playback of an initial sound signal, the background noise is first recorded within the given area where the initial sound signal is to be played back to obtain a background sound signal. Then, the initial sound signal is played back and recorded within the given area to obtain a recorded initial sound signal. The recorded background sound signal is then subtracted from the recorded initial sound signal to obtain a denoised sound signal. The ratio between the denoised sound signal and a target sound signal is then calculated. The calculated ratio is then applied to the initial sound signal to obtain a calibrated sound signal. When played back by the sound system, the calibrated sound signal substantially corresponds to the target sound signal. The calibrated sound signal is then outputted. For example, the calibrated sound signal may be stored in memory or sent to the sound system to be played back.

In one embodiment, the present method and system may be used in a simulator such an aircraft simulator, a tank simulator, a ship simulator, or the like. Because the specific environment of a simulator may affect the way a user of the simulator perceives a played back sound that is supposed to replicate the sound heard in a real system that the simulator simulates, calibration of the sound signal to be played back in the simulator may be desired to improve the experience of the user and render the simulation more realistic. For example, it may be of value to consider the background noise generated by pieces of equipment that are specific to the simulator, i.e. pieces of equipment of the simulator which are not present in the real system that the simulator simulates. For example, an air conditioning (AC) system may be present in the simulator for the comfort of the user of the simulator while the real system may comprise no AC system. In this case, the sound generated by the components of the AC system such as fans will affect the way the user perceives a sound signal played back by the simulator. The sound generated by the AC system then corresponds to background noise. Compensating for the background noise so that it does not affect the user perception of a sound signal played back by the simulator will improve the user experience.

Furthermore, the environment of the simulator such as the walls of the simulator may affect the user perception of a sound signal played back by the simulator. While playing back a sound signal, it is expected that the user will hear the sound as if the was present in the real system. Usually, the sound heard in the real system that the simulator simulates is recorded and then played back into the simulator expecting that the perception of the user within the simulator would be identical to the perception he would have in the real system. However, since the environment of the simulator is usually different from that of the real system, the sound perceived by the user in the simulator may be different from the sound he would perceive in the real system even if the sound played back in the simulator has been recorded in a real system. For example, the sound played back in the simulator may be distorted due to the simulator environment. The present method and system allows for at least partially compensating for these drawback effects and improve the user experience.

In same or another embodiment, multiple sounds may be played back during a same simulation to reproduce different sources of sound present in the real system being simulated. For example, a simulator may generate a first sound for reproducing the wind noise and a second sound for reproducing the sound generated by turbines. During a given portion of the simulation, the first sound corresponding to the wind noise will affect the way the user perceives a second sound corresponding to the turbine noise. The second sound then corresponds to background noise. Compensating for the background noise so that it does not affect the user perception of a second sound played back by the simulator may improve the user experience.

FIG. 1 illustrates one embodiment of a method 10 for calibrating an initial sound signal. The initial sound signal is to be played back by a playback system and modified so as to improve the user perception of the initial sound signal while played back. In one embodiment, the initial sound signal may correspond to a sound signal that was previously recorded in a given environment. In another embodiment, the initial sound signal may be a sound signal generated by a computer machine.

For example, the initial sound signal may be used to reproduce the sound perceived by a pilot while flying in a real aircraft. In this case, the initial sound signal may correspond to the sound signal recorded in the cockpit of a real aircraft while in operation. In another example, the initial sound signal may have been previously designed and generated by a computer machine to mimic the sound heard in the real system.

It should be understood that the method 10 is to be executed by a computer or computer machine comprising at least a communication unit for receiving and transmitting data, a memory for storing data and a processing unit. The memory has stored thereon statements that when executed by the processing unit perform the method 10.

At step 12, an initial sound signal, a target sound signal, a recorded initial sound signal and a recorded background sound signal, all expressed in Pa, are received. Each one of these sound signals comprise a respective sound amplitude value for a plurality of frequencies contained in a given range of frequencies. As described above, the initial sound signal is the signal to be played back. The recorded initial sound signal corresponds to the sound signal that was previously recorded while the initial sound signal was played back in a given area. The recorded background sound signal corresponds to the background noise that is present in the area where the initial sound signal is to be played back and that was previously recorded while the initial sound signal is not played back.

In an embodiment in which the method 10 is used in an aircraft simulator, the initial sound signal may correspond to the sound heard in the cockpit of the aircraft during a respective operation of the aircraft. In this case, the initial sound signal may correspond to the recording of the sound present in the cockpit. In another example, the initial sound signal may be generated by a computer.

At step 14, the recorded background sound signal is subtracted from the recorded initial sound signal, i.e. the amplitude of the recorded background sound signal for each frequency is subtracted from the amplitude of the recorded initial sound signal for the same frequency, thereby obtaining a denoised sound signal.

In one embodiment, the recorded initial sound signal and the recorded background sound signal are expressed in a logarithmic scale such as in Decibels (dB). For example, the sound signals may be expressed in dB SPL to correspond to sound pressure levels. In this case, a sound signal p expressed in Pa may be converted into a sound pressure level Lp using the following equation: $Lp=\ln(p/p_0)$ where $p_0$ is a reference sound pressure. As known in the art, $p_0$ is equal to 20 μPa when the logarithm scale is in dB SPL.

When the recorded initial sound signal and the recorded background sound signal are expressed in a logarithmic scale such as in DB SPL, the method 10 further comprises a step of converting the recorded initial sound signal and the recorded background sound signal into Pascal before subtracting the recorded background sound signal expressed in Pa from the recorded initial sound signal expressed in Pa to obtain a denoised sound signal also expressed in Pa. The method further comprises a step of converting the obtained denoised signal expressed in Pa into the same logarithmic scale as that of the recorded initial sound signal and the recorded background sound signal, such as in dB SPL.

At step 16, the target sound signal is divided by the denoised sound signal obtained at step 14, thereby obtaining a compensation factor. It should be understood that at step 16, the amplitude of the target sound signal for each frequency is divided by the amplitude of the denoised sound signal for the same frequency.

In one embodiment, the denoised sound signal and the target sound signal may be expressed in a logarithmic scale. For example, the denoised sound signal and the target sound signal can be expressed in dB SPL. In this case, the person skilled in the art will understand step 16 consists in subtracting the denoised sound signal expressed in the logarithmic scale from the target sound signal expressed in the logarithmic scale to obtain the compensation factor expressed in the logarithmic scale.

At step 18, the initial sound signal is divided the compensation factor obtained at step 16, thereby obtaining a calibrated sound signal. It should be understood that at step 18, the amplitude of the initial sound signal for each frequency is divided by the amplitude of the compensation factor for the same frequency.

In one embodiment, the initial sound signal and the compensation sound signal may be both expressed in a logarithmic scale. For example, the initial sound signal and the compensation sound signal can be expressed in dB SPL. In this case, the person skilled in the art will understand step 18 consists in subtracting the compensation factor expressed in the logarithmic scale from the initial sound signal expressed in the logarithmic scale to obtain the calibrated sound signal expressed in the logarithmic scale.

Finally, the calibrated sound signal is outputted at step 20. In one embodiment, the calibrated sound signal is stored in memory. In the same or another embodiment, the calibrated sound signal is played back.

In one embodiment, the target sound signal corresponds to a sound signal that has been previously recorded. In another embodiment, the target sound signal is generated by a computer. In this case, the method 10 may further comprise the step of generating the target sound signal.

In one embodiment, the method 10 further comprises recording the background noise present in the area in which the initial sound signal is to be played back, thereby obtaining the recorded background sound signal. In one embodiment, the background noise is recorded while no sound signal is played back to obtain the recorded background sound signal. In another embodiment, the background noise is recorded while the initial sound signal is played back while muted, to obtain the recorded background sound signal.

In one embodiment, the method 10 further comprises recording the initial sound signal while it is being played back, thereby obtaining the recorded initial sound signal. In one embodiment, the method 10 further comprises playing back the initial sound signal.

In one embodiment, the above-described method 10 may be used to calibrate a sound signal to be played back into a simulator such as an aircraft simulator. In this case, the target sound signal may be previously recorded into the cockpit of a real aircraft that the simulator simulates while the aircraft is in use.

In one embodiment, the initial sound signal may be a random sound signal, i.e. a sound signal for which the amplitude of each frequency is randomly chosen. For example, the initial sound signal may correspond to white noise. In one embodiment, the method 10 may further comprise generating the initial sound signal.

In another embodiment, the initial sound signal may be selected from a database of predefined initial sound signals. In this case, the method 10 may further comprise a step of receiving an identification of a given predefined target sound signal and a step of retrieving the given predefined target sound signal.

For example, the database may comprise an initial sound signal for different flight phases such as a first initial sound signal for cruise, a second initial sound signal for the takeoff phase, a third initial sound signal for the landing phase, a fourth initial sound signal for the opening of wing flaps, etc. In this case, the method 10 may further comprise a step of receiving an identification of a flight phase and retrieving from the database the initial sound signal that corresponds to the received flight phase. Similarly, the database may comprise a respective target sound signal for different flight phases and the method 10 may further comprise a step of receiving an identification of a flight phase and retrieving the target sound signal that corresponds to the received flight phase.

As described below, the initial sound signal may be first played back while being muted, i.e. the volume of the playback is set to zero, and the background noise is recorded within the simulator concurrently to the muted playback of the initial sound signal to obtained the background sound signal 30 illustrated in FIG. 2. It should be understood that the amplitude or sound level of the sound signals illustrated in FIG. 2 are expressed in scaled dB SPL.

Figure 2:
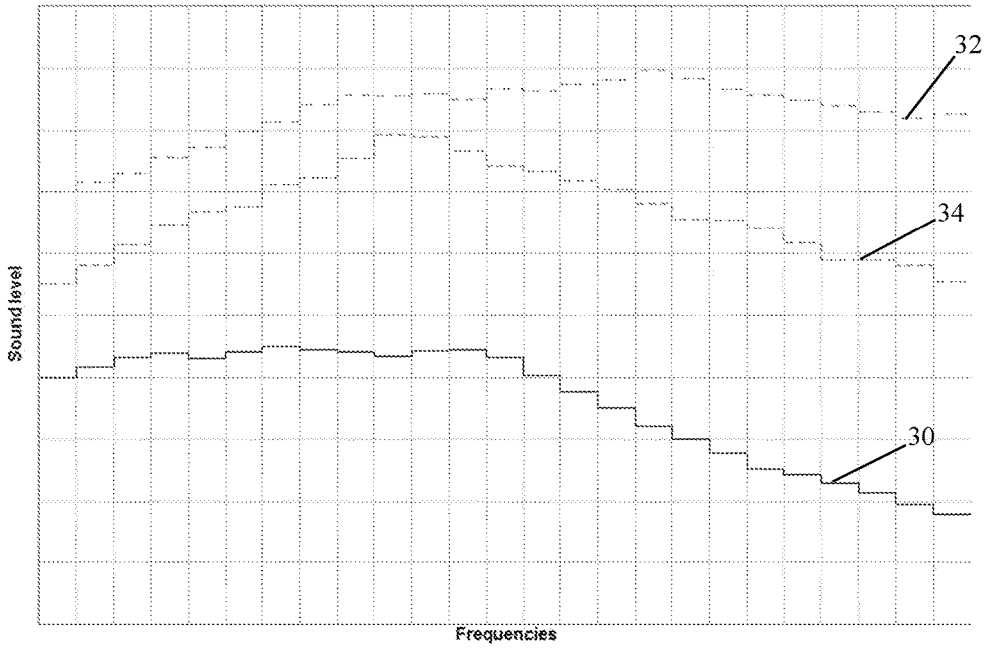
FIG. 2 is an exemplary graph illustrating the amplitude as a function of frequency for a recorded initial sound signal, a target sound signal to be achieved and a recorded background sound signal.

Then the initial sound signal is played back at a non-zero volume and the played back initial sound signal is recorded within the simulator to obtain the recorded initial sound signal 32 illustrated in FIG. 2. In one embodiment, the volume is set to maximum during the playback of the initial sound signal.

Then both the recorded background sound signal 30 and the recorded initial sound signal 32 are converted from dB SPL into Pa and the recorded background sound signal expressed in Pa is subtracted from the recorded background sound signal also expressed in Pa to obtain the denoised sound signal which is converted into dB SPL. The denoised sound signal expressed in dB SPL is then subtracted from the target sound signal 34, thereby obtaining a compensation factor. The compensation factor is then subtracted from the initial sound signal to obtain a calibrated sound signal. The obtained calibrated sound signal may then be played back and the played back calibrated sound signal substantially corresponds to the target sound signal so that the sound environment of user of the simulator corresponds to the sound environment of the cockpit of the real aircraft that the simulator simulates, which improves the experience of the user.

The above-described method may be embodied as a computer program product for calibrating a predefined sound signal. The computer program product comprises a computer readable memory storing computer executable instructions thereon that when executed by a computer perform the steps of the above-described method.

Figure 3:
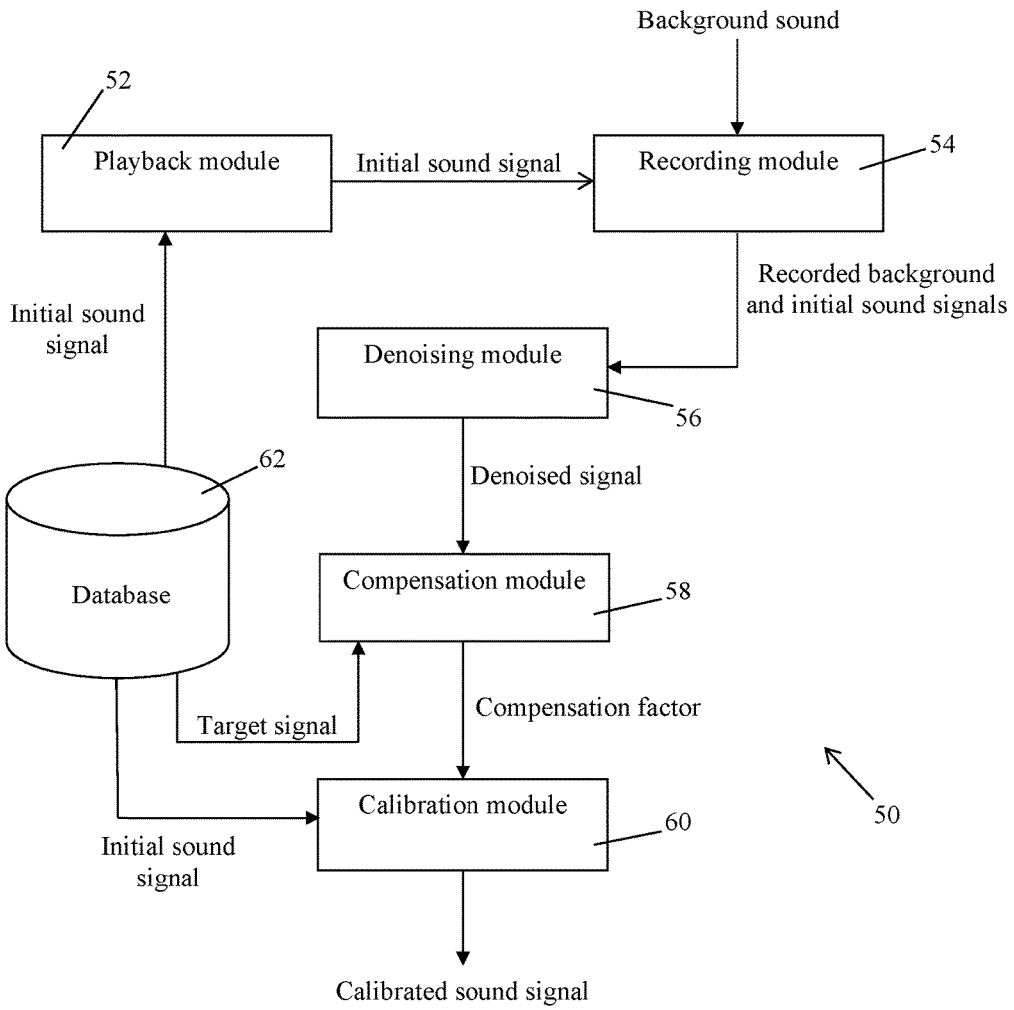
FIG. 3 is a block diagram illustrating a system for calibrating an initial sound signal, in accordance with an embodiment.

FIG. 3 illustrates one embodiment of a system 50 for calibrating a sound signal which may be used in a simulator. The system 50 comprises a playback module 52, a recording module 54, a denoising module 56, a compensation module 58, a calibration module 60 and a database 62. The database 62 stores at least one initial sound signal and a target sound signal.

The playback module 52 comprises at least one speaker and is adapted to playback the initial sound signal. In one embodiment, the playback module 52 further comprises a processing unit, a memory and communication means, and is further adapted to receive the predefined sound signal and the additional sound signal from the database 62 and combine them together.

In one embodiment, the playback module 52 may adjust the volume of the playback of the initial sound signal. For example, the initial sound signal may be played back while muted.

The recording module 54 comprises a microphone for recording sound and is adapted to record the background sound to generate a recorded background sound signal and a recorded initial sound signal. The recorded background sound signal and the recorded initial sound signal are transmitted to the denoising module 56. In one embodiment, the denoising module 56 is adapted to subtract the recorded background sound signal from the recorded initial sound signal to obtain a denoised sound signal. Alternatively, if the sound signals are expressed in a logarithmic scale such as in dB SPL, the denoising module 56 is further configured for converting the recorded background sound signal and the recorded initial sound signal from the logarithmic scale into Pa before subtracting the recorded background sound signal expressed in Pa from the recorded initial sound signal also expressed in Pa to obtain a denoised sound signal expressed in Pa. The denoising module 56 is further configured for converting the denoised sound signal expressed in Pa into the logarithmic scale. The denoised sound signal is then transmitted to the compensation module 58.

The compensation module 58 receives the target sound signal from the database 62. In one embodiment, the compensation module 58 is configured for dividing the target sound signal by the received denoised sound signal to obtain a compensation factor. Alternatively, if the target sound signal and the denoised sound signal are expressed in a logarithmic scale, the compensation module 58 is configured for subtracting the denoised sound signal from the target sound signal to obtain the compensation factor. The compensation factor is then transmitted to the calibration module 60.

The calibration module 60 then retrieves the initial sound signal from the database 62, and received the compensation factor from the compensation module 58. In one embodiment, the calibration module 60 is configured for dividing the initial sound signal by the compensation factor to obtain a calibrated sound signal. Alternatively, if the initial sound signal and the compensation factor are expressed in a logarithmic scale, the calibration module 60 is configured for subtracting the received compensation factor from the initial sound signal to obtain the calibrated sound signal. The compensation module 60 then outputs the calibrated sound signal. For example, the calibrated sound signal may be stored in memory. In the same or another embodiment, the compensation module 60 transmits the calibrated sound signal to the playback module 52 to be played back.

It should be understood that at least some of the steps of the method 10 may be performed by a computer machine provided with at least one processing unit, a memory or storing unit, and communication means. The memory comprises statements and instructions stored thereon that, when executed by the processing unit, performs at least some of the steps of the method 10.

In one embodiment, each one of the modules 52-60 is provided with a respective processing unit such as a microprocessor, a respective memory and respective communication means. In another embodiment, at least two of the modules 52-60 may share a same processing unit, a same memory and/or same communication means. For example, the system 50 may comprise a single processing unit used by each module 52-60, a single memory on which the database 62 is stored and a single communication unit.

Figure 4:
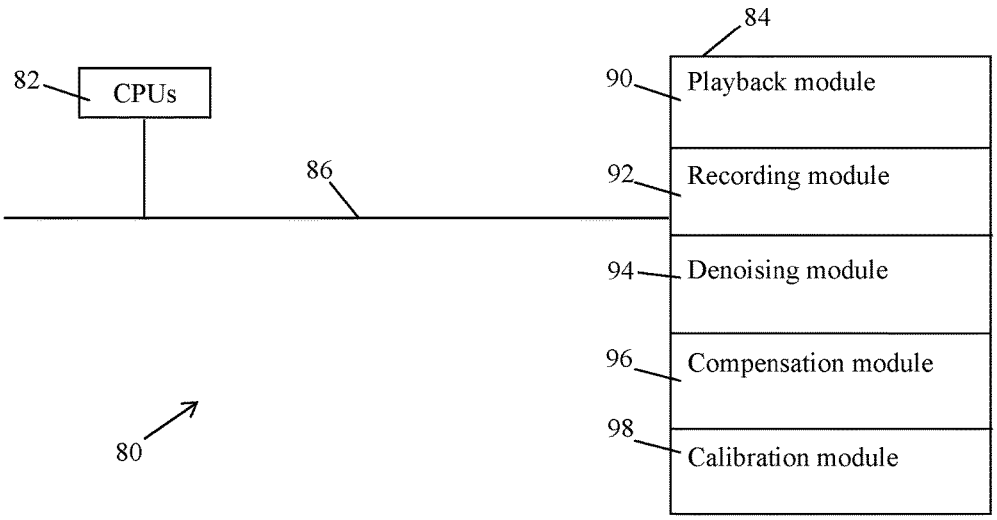
FIG. 4 is a block diagram of a processing module adapted to execute at least some of the steps of the method of FIG. 1, in accordance with an embodiment.

FIG. 4 is a block diagram illustrating an exemplary processing module 80 for executing the steps 12 to 20 of the method 10, in accordance with some embodiments. The processing module 80 typically includes one or more Computer Processing Units (CPUs) and/or Graphic Processing Units (GPUs) 82 for executing modules or programs and/or instructions stored in memory 84 and thereby performing processing operations, memory 84, and one or more communication buses 86 for interconnecting these components. The communication buses 86 optionally include circuitry (sometimes called a chipset) that interconnects and controls communications between system components. The memory 84 includes high-speed random access memory, such as DRAM, SRAM, DDR RAM or other random access solid state memory devices, and may include non-volatile memory, such as one or more magnetic disk storage devices, optical disk storage devices, flash memory devices, or other non-volatile solid state storage devices. The memory 84 optionally includes one or more storage devices remotely located from the CPU(s) 82. The memory 84, or alternately the non-volatile memory device(s) within the memory 84, comprises a non-transitory computer readable storage medium. In some embodiments, the memory 84, or the computer readable storage medium of the memory 84 stores the following programs, modules, and data structures, or a subset thereof:

a playback module 90 for playing back an initial sound signal;

a recording module 92 for recording a background sound signal and the played back initial sound signal;

a denoising module 94 subtracting the recorded background signal from the recorded initial sound signal to obtain a denoised sound signal;

a compensation module 96 for one of dividing the target sound signal by the denoised sound signal or subtracting the denoised sound signal from the target sound signal to obtain a compensation factor; and a calibration module 98 for one of dividing the initial sound signal by the compensation factor in linear Pascal scale or subtracting the compensation factor from the initial sound signal in logarithm scale to obtain a calibrated sound signal, and outputting the calibrated sound signal.

Each of the above identified elements may be stored in one or more of the previously mentioned memory devices, and corresponds to a set of instructions for performing a function described above. The above identified modules or programs (i.e., sets of instructions) need not be implemented as separate software programs, procedures or modules, and thus various subsets of these modules may be combined or otherwise re-arranged in various embodiments. In some embodiments, the memory 84 may store a subset of the modules and data structures identified above. Furthermore, the memory 84 may store additional modules and data structures not described above.

Although it shows a processing module 80, FIG. 4 is intended more as functional description of the various features which may be present in a management module than as a structural schematic of the embodiments described herein. In practice, and as recognized by those of ordinary skill in the art, items shown separately could be combined and some items could be separated.

The embodiments of the invention described above are intended to be exemplary only. The scope of the invention is therefore intended to be limited solely by the scope of the appended claims.

I claim:

1. A computer-implemented method for calibrating a sound signal, comprising:

receiving an initial sound signal, a recorded background sound signal, a recorded initial sound signal and a target sound signal;

subtracting the recorded background sound signal from the recorded initial sound signal, thereby obtaining a denoised sound signal;

dividing the target sound signal by the denoised sound signal, thereby obtaining a compensation factor;

dividing the initial sound signal by the compensation factor, thereby obtaining a calibrated sound signal; and outputting the calibrated sound signal.

2. The computer-implemented method of claim 1, wherein the initial sound signal, the recorded background sound signal, the recorded initial sound signal and the target sound signal are expressed in a logarithmic scale, the method further comprising converting the initial sound signal and the recorded background sound signal from the logarithmic scale into a linear Pascal (Pa) scale before said subtracting the recorded background sound signal from the recorded initial sound signal and converting the denoised sound signal from the linear Pa scale into the logarithmic scale, said dividing the target sound signal by the denoised sound signal comprises subtracting the denoised sound signal from the target sound signal and said dividing the initial sound signal by the compensation factor comprises subtracting the compensation factor from the initial sound signal.

3. The computer-implemented method of claim 1, further comprising recording background noise, thereby obtaining the recorded background sound signal.

4. The computer-implemented method of claim 1, further comprising playing back the initial sound signal.

5. The computer-implemented method of claim 4, further comprising recording the played back initial sound signal, thereby obtaining the recorded initial sound signal.

6. The computer-implemented method of claim 1, wherein the initial sound signal comprises a white noise signal.

7. The computer-implemented method of claim 6, wherein the noise signal comprises one of a random noise signal and a predetermined noise signal.

8. The computer-implemented method of claim 1, further comprising:

receiving an identification; and retrieving one of said initial sound signal and said target sound signal from a database based on said identification.

9. The computer-implemented method of claim 8, wherein the identification comprises a given flight phase.

10. The computer-implemented method of claim 1, wherein said outputting the calibrated sound signal comprises at least one of storing the calibrated sound signal and playing back the calibrated signal.

11. The computer-implemented method of claim 3, further comprising playing back and muting the predefined audio signal while said recording the background sound signal.

12. A computer program product for calibrating a predefined sound signal, the computer program product comprising a computer readable memory storing computer executable instructions thereon that when executed by a computer perform the method steps of claim 1.

13. A system for calibrating a predefined sound signal, the system comprising a communication unit for at least one of receiving and transmitting data, a memory and processing unit configured for executing the method steps of claim 1.

14. A system for calibrating a predefined sound signal, the system comprising:

a playback module for playing back an initial sound signal, the playback module comprising at least one loudspeaker;

a recording module for recording background noise to obtain a background sound signal and recording the played back initial sound signal to obtain a recorded initial signal, the recording module comprising a microphone;

a denoising module for subtracting the recorded background sound signal from the recorded initial sound signal to obtain a denoised sound signal;

a compensation module for receiving a target sound signal and dividing the target sound signal by the denoised sound signal to obtain a compensation factor; and a calibration module for:

dividing the initial sound signal by the compensation factor to obtain a calibrated sound signal; and outputting the calibrated sound signal.

15. The system of claim 14, wherein the initial sound signal, the recorded background sound signal, the recorded initial sound signal and the target sound signal are expressed in a logarithmic scale, the denoising module is further configured for converting the initial sound signal and the recorded background sound signal from the logarithmic scale into a linear Pascal (Pa) scale before subtracting the recorded background sound signal from the recorded initial sound signal and converting the denoised sound signal from the linear Pa scale into the logarithmic scale, the compensation module is configured for subtracting the denoised sound signal from the target sound signal and the calibration module is configured for subtracting the compensation factor from the initial sound signal.

16. The system of claim 14, wherein the initial sound signal comprises a white noise signal.

17. The system of claim 16, wherein the noise signal comprises one of a random noise signal and a predetermined noise signal.

18. The system of claim 14, wherein the playback module is further configured for:

receiving an identification; and retrieving one of said initial sound signal and said target sound signal from a database based on said identification.

19. The system of claim 18, wherein the identification comprises a given flight phase.

* * * * *